US008208840B2

(12) United States Patent
Takahashi

(10) Patent No.: US 8,208,840 B2
(45) Date of Patent: Jun. 26, 2012

(54) DEVELOPER CARRIER, DEVELOPING DEVICE, IMAGE FORMING APPARATUS, PROCESS CARTRIDGE, AND IMAGE FORMING METHOD

(75) Inventor: Yasufumi Takahashi, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 592 days.

(21) Appl. No.: 12/379,665

(22) Filed: Feb. 26, 2009

(65) Prior Publication Data

US 2009/0226221 A1 Sep. 10, 2009

(30) Foreign Application Priority Data

Mar. 10, 2008 (JP) ..... 2008-058999
Oct. 9, 2008 (JP) ..... 2008-262617

(51) Int. Cl.
*G03G 15/09* (2006.01)

(52) U.S. Cl. ..... 399/286

(58) Field of Classification Search ..... 399/265, 399/279, 286
See application file for complete search history.

(56) References Cited

U.S. PATENT DOCUMENTS

| | | | |
|---|---|---|---|
| 5,565,968 | A | 10/1996 | Sawa et al. |
| 2008/0181670 | A1 | 7/2008 | Tsuda et al. |
| 2008/0220179 | A1 | 9/2008 | Akama et al. |

FOREIGN PATENT DOCUMENTS

| | | |
|---|---|---|
| EP | 0 895 135 | 2/1999 |
| JP | 60-256170 | 12/1985 |
| JP | 61-023180 | 1/1986 |
| JP | 07-013410 | 1/1995 |
| JP | 2000-242073 | 9/2000 |
| JP | 2003-208012 | 7/2003 |
| JP | 2003-316146 | * 11/2003 |
| JP | 2005-084656 | 3/2005 |
| WO | WO 2006/033353 | 3/2006 |

OTHER PUBLICATIONS

Extended European Search Report dated May 20, 2009 for corresponding European Appln. No. 09153755.5.

* cited by examiner

*Primary Examiner* — Hoang Ngo
(74) *Attorney, Agent, or Firm* — Harness, Dickey & Pierce, P.L.C.

(57) ABSTRACT

A developer carrier which holds a developer on a surface and is rotatable includes: a plurality of grooves which is formed on the surface, wherein each of the grooves is wavy-lined, an inclination direction of the grooves to an axis of the developer carrier is cyclically changed in an opposite direction, and the grooves are respectively arranged at intervals.

17 Claims, 8 Drawing Sheets

DEVELOPER CARRIER, DEVELOPING DEVICE, IMAGE FORMING APPARATUS, PROCESS CARTRIDGE, AND IMAGE FORMING METHOD

CROSS-REFERENCE TO RELATED APPLICATIONS

The present invention is based on and claims priority from Japanese patent application numbers 2008-058999, filed Mar. 10, 2008, and 2008-262617, filed Oct. 9, 2008 the disclosures of which are incorporated herein in their entireties.

BACKGROUND

The present invention relates to a developer carrier, a developing device used for a copier, a facsimile, a printer and so on, and a process cartridge, an image forming apparatus, and an image forming method using therefor.

Generally, in a developing device using a two-component developer, a developing sleeve (developer roller) with a rough surface is used as a developer carrier. As methods of forming the rough surface of the developer roller, a blasting process, such as a sandblasting and so on, which roughens a surface and forms an irregular fine rough surface, and a grooving process, which cuts a cyclic groove on a surface, are practically used.

In the developer roller by the blasting process, compared with the developer roller by the grooving process, a cyclic unevenness in a distribution of the developer seldom occurs and the distribution is uniform, and thereby a picture quality is generally excellent. However, with a long-time use, a fine roughness on the surface is abraded and degraded. Accordingly, a carrying ability of the developer is degraded, a developer carried to a developing area is reduced with time, and a problem of a degradation of a density or an unevenness of the density may occur. On the other hand, in the developer roller by the grooving process, a degradation of the roughness on the surface with time is small; therefore the carrying ability of the developer is stable.

As for the grooving process, as illustrated in FIGS. 4 and 5, a linear v-shape groove, in which a triangle-shape cross-section is cyclically cut parallel to an axis of the developer roller on the surface of the developer roller, is widely used. However, in the linear v-shape groove, a uniformity of the distribution of the developer is degraded by an unevenness of carrying the developer corresponding to a groove pitch. And therefore, an unevenness of a pitch corresponding to the groove pitch in a circumferential direction and a degradation of a dot reproducibility may occur. In addition, the linear v-shape groove is formed perpendicularly to a carrying direction of the developer; therefore it is hard for the developer to move in an axis direction while being carried to the developing area. If it is hard for the developer to move in the axis direction, the developer is carried to the developing area in a state of having a subtle unevenness in regard to the axis direction in a case of being held by the developer roller, and the unevenness of the density in regard to the axis direction and the degradation of the dot reproducibility may occur. Thus, in the developer roller by the grooving process, in order to prevent the degradation of the picture quality by the unevenness of the density of an image and the degradation of the dot reproducibility, improving the uniformity of the distribution of the developer on the developer roller is required.

On the other hand, various kinds of shape of a groove on the surface of the developer roller have been proposed. For example, as illustrated in FIG. 6, Japanese patent publication number S60-256170 discloses that a diagonal groove which is inclined in one direction to the axis is formed uniformly in the circumferential direction. In the diagonal groove, the unevenness of carrying the developer corresponding to the groove pitch in regard to the circumferential direction is prevented, and since the developer is also moveable in the axis direction when the developer is carried, the uniformity of the distribution of the developer is improved. However, since the groove is inclined to the one direction to the axis, the developer receives a force in one side direction to the axis and may lean to one side end. In the one side end where the developer leans, a density rise or a stress of the developer is increased, and in the other side end, a degradation of the density or a cyclic unevenness is easily conspicuous.

Additionally, as illustrated in FIG. 7, for example, Japanese patent publication numbers 2000-242073 and 2003-208012 disclose a diagonal grid groove where a gird interval is formed uniformly on a surface. In the diagonal grid groove, grooves are criss-crossed, and thereby the developer does not lean to the one side on the developer roller and the uniformity of the distribution is improved.

However, in the diagonal grid groove, there are intersections of the groove, and at the intersections, an unevenness of the density of the image, such as a vertical white stripe which is called an unevenness of an intersection, may newly occur.

SUMMARY

An object of the present invention is to provide a developer carrier, a developing device, an image forming apparatus, a process cartridge, and an image forming method. The above object is achieved by the developer carrier having a rough surface by a grooving process which carries a developer in a state of being uniformly distributed to a developing area, and thereby an unevenness of a density of an image is controlled, a dot reproducibility is improved, and a high-quality image is obtained.

In order to achieve the above object, the present invention provides a developer carrier which holds a developer on a surface and is rotatable, comprising: a plurality of grooves which is formed on the surface, wherein each of the grooves is wavy-lined, an inclination direction of the grooves to an axis of the developer carrier is cyclically changed in an opposite direction, and the grooves are respectively arranged at intervals.

Preferably, a top part of a mountain or a bottom part of a valley of the grooves is curved.

Preferably, the grooves are formed so that the top part of the mountain of a first groove and the bottom part of the valley of a second groove next to the first groove are overlapped when looking from a perpendicular direction to an axis direction or from the axis direction.

Preferably, a pitch of the grooves is less than or equal to 0.4 mm.

Preferably, the bottom part of the grooves is flat.

Preferably, a volume of the grooves per unit area of the surface is equal to or more than 0.03 $mm^3$.

In addition, the present invention provides a developing device, comprising: a developer carrier which holds a developer on a surface and is rotatable, including: a plurality of grooves which is formed on the surface, wherein each of the grooves is wavy-lined, an inclination direction of the grooves to an axis of the developer carrier is cyclically changed in an opposite direction, and the grooves are respectively arranged at intervals.

Preferably, a top part of a mountain or a bottom part of a valley of the grooves is curved.

Preferably, the grooves are formed so that the top part of the mountain of a first groove and the bottom part of the valley of a second groove next to the first groove are overlapped when looking from a perpendicular direction to an axis direction or from the axis direction.

Preferably, a pitch of the groove is less than or equal to 0.4 mm.

Preferably, the bottom part of the grooves is flat.

Preferably, a volume of the grooves per unit area of the surface is equal to or more than 0.03 $mm^3$.

In addition, the present invention provides a process cartridge which is detachable from a main body of an image forming apparatus, comprising: an image carrier, at least one of an electrostatic charger and a cleaner; and a developing device according to any one of those developing devices described above.

Moreover, the present invention provides an image forming apparatus, comprising: an image carrier; an electrostatic charger which forms an electrostatic latent image on the image carrier; and a developing device which develops the electrostatic latent image according to any one of those developing devices described above.

Furthermore, the present invention provides an image forming method, comprising: forming an electrostatic latent image on an image carrier where a surface is electrically-charged by an electrostatic charger; developing the electrostatic latent image into a toner image by the developing device; transferring the toner image onto a recording medium; and fusing a toner on the recording medium by a fuser, wherein the developing device according to any one of those developing devices described above is adopted.

DETAILED DESCRIPTION OF THE PREFERRED EMBODIMENTS

Embodiment

Figure 1:
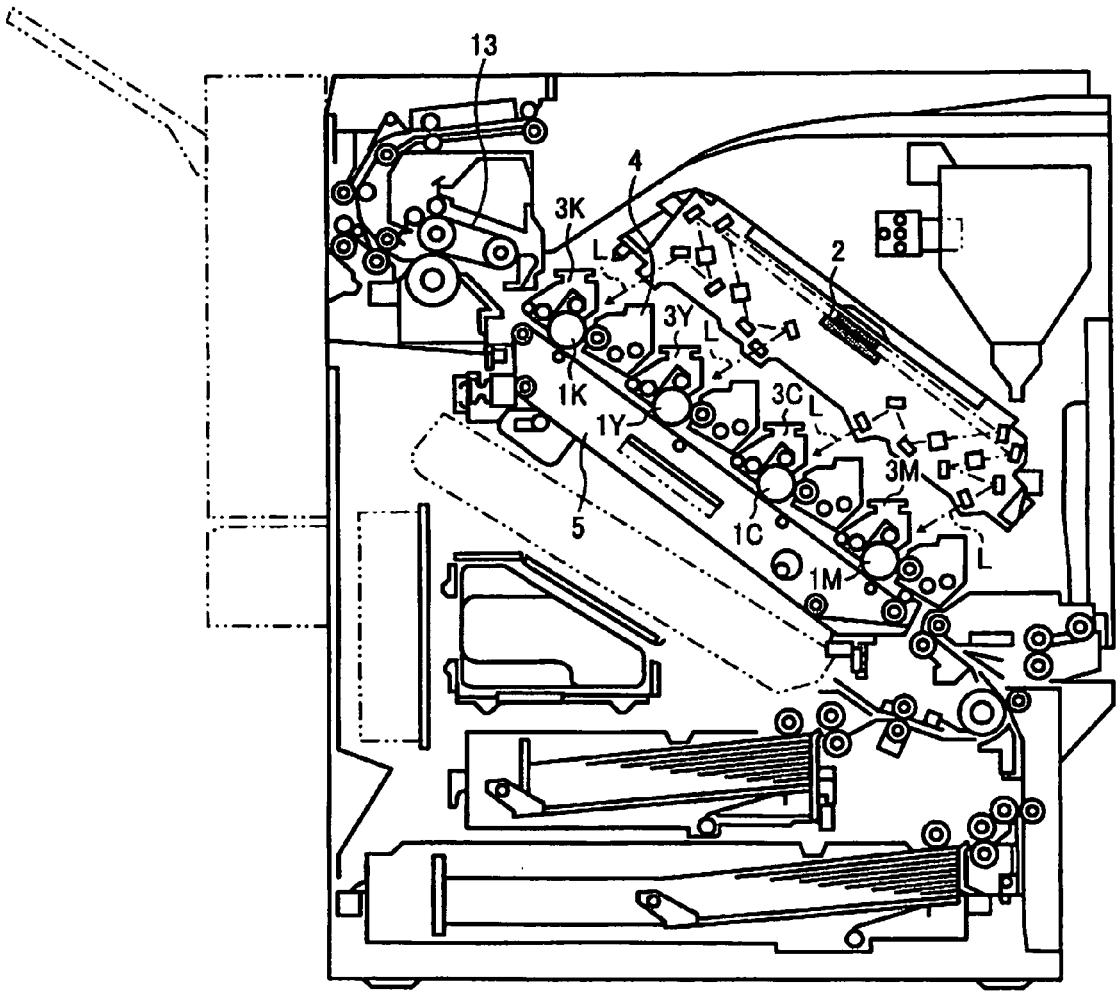
FIG. 1 is a schematic structure diagram of a whole of an image forming apparatus according to an embodiment of the present invention.

Hereinafter, an embodiment applied to an image forming apparatus according to the present invention will be explained. Firstly, a structure and a movement of the image forming apparatus will be explained. FIG. 1 is a schematic structure view of a whole of the image forming apparatus according to the present embodiment. This image forming apparatus is a tandem-type image forming apparatus, and has a transfer belt 5 which is capable of an endless surface movement in a center part in FIG. 1. Above the transfer belt 5, four toner image forming units 3M, 3C, 3Y, 3K which form toner images of magenta (M), cyan (C), yellow (Y) and black (K) are provided. These toner image forming units 3M, 3C, 3Y, 3K respectively have photoreceptors 1M, 1C, 1Y, 1K which hold an electrostatic latent image. And above the toner image forming units 3M, 3C, 3Y, 3K, an optical writing unit 2 is disposed, and discharges a laser beam L which is emitted based on image information toward each photoreceptor 1M, 1C, 1Y, 1K, and exposes and scans a surface of the photoreceptor. In a downstream part of a carrying direction of the transfer belt 5, a fuser 13 which fuses an unfused toner on a recording medium is provided.

The toner image forming units 3M, 3C, 3Y, 3K respectively uses different color toners (M, C, Y, K) as image forming materials, and they have the same structures except for using different color toners. Therefore, hereinafter, the toner image forming unit is denoted by a numeral 3 without M, C, Y and K, and also the photoreceptor is denoted by a numeral 1 without M, C, Y and K, and the structures and the movements of the toner image forming unit 3 and the photoreceptor 1 will be explained Around the photoreceptor 1, an electrostatic charger, a developing device 4, and a cleaner are respectively disposed. The photoreceptor 1, after electrostatic charging a surface by the electrostatic charger, forms an electrostatic latent image on the surface by discharge of a laser beam L by the optical writing unit 2. This electrostatic latent image is developed into a toner image by the developing device 4 using a two-component developer comprising a toner and a magnetic carrier. And the toner image is sequentially transferred onto recording paper carried by the transfer belt 5, and thereby a four-color combined image (hereinafter, four-color toner image) is formed on the recording paper. The four-color toner image is fused on the recording paper by the fuser 13 and a full color image is formed. A developer which is not transferred and remains on the photoreceptor 1 is cleaned by the cleaner, and is prepared for another image forming.

Figure 2:
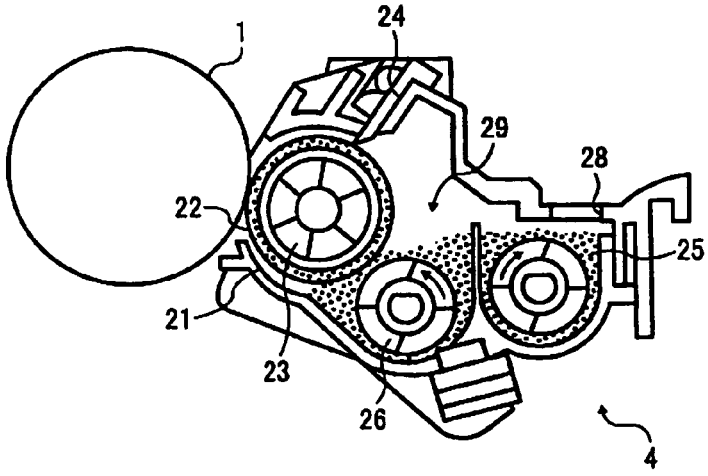
FIG. 2 is a schematic structure diagram of a developing device.

Next, the developing device 4 will be explained. FIG. 2 is a schematic structure diagram of the developing device 4. The developing device 4 comprises the developer roller 22 having a magnetic field generator 23 inside, which is rotatable and nonmagnetic, as a developer carrier which holds and carries the developer to a facing part of the photoreceptor 1. And in the developing device 4, carrying screws 25, 26, which agitate the developer in a developer storing room 29 which stores the developer and carry the developer in an opposite direction along the axis to each other, are provided in a developer casing 21. The carrying screw 26, which is close to the developer roller 22, of these carrying screws 25, 26 has a function of providing the developer to the developer roller 22. A space between the carrying screws 25, 26 is divided by a divider and thereby the developer which is being carried is not mixed in. A downstream end in a carrying direction of the carrying screw 26 and an upstream end in the carrying direction of the carrying screw 25 are in communication, and the developer carried by the carrying screw 26 is passed to the carrying screw 25, and is agitated and carried by the carrying screw 25. And a toner is supplied according to a consumption amount from a toner supplier 28, and the toner and the developer are agitated and carried. Additionally, a downstream end in a carrying direction of the carrying screw 25 and an upstream end in the carrying direction of the carrying screw 26 are in communication, and the developer agitated enough and carried by the carrying screw 25 is passed to the carrying screw 26, and is provided to the developer roller 22. Thus, a circulating carrying of the developer is performed, and the developer is made uniform, and the developer in which a toner density is stable is provided.

Figure 3:
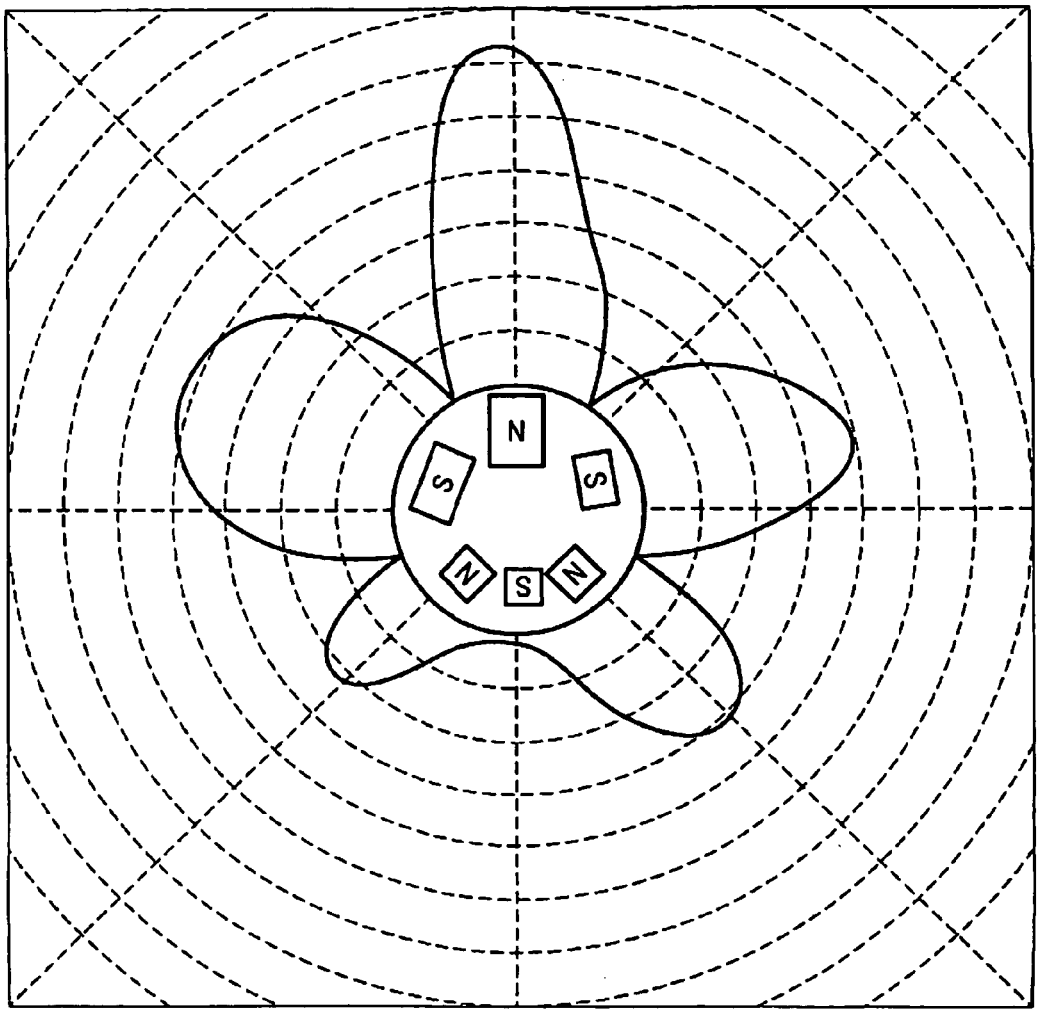
FIG. 3 is a distribution map of a size of a magnetic flux density on a developer roller surface by a magnetic field generator.

A provision of the developer to the developer roller 22 is performed such that the magnetic field generator 23 in the developer roller 22 attracts the magnetic carrier of the developer carried by the carrying screw 26. FIG. 3 is a distribution map of a magnetic flux density of a developer roller 22 surface by the magnetic field generator 23. The developer held on the developer roller 22 surface by the magnetic field generator 23 is carried to a developing area, which is a facing part to the photoreceptor 1, by a rotation of the developer roller 22.

In an upstream part in a rotating direction of the developer roller 22 above the developing area, a developing doctor (doctor blade) 24 as a developer regulator is provided to regulate the developer on the developer roller 22 so that a thickness of the developer is uniform.

Next, a rough surface of the developer roller 22, a characteristic of the embodiment of the present invention, will be explained. As for methods of forming the rough surface of the developer roller 22, a blasting process such as a sandblasting, a magnetic polishing and so on which roughens a surface to form an irregular fine rough surface, and a grooving process which cuts a cyclic groove on a surface are practically used. In the blasting process, the distribution of the developer on the surface is more stable than in the grooving process, therefore a picture quality is generally excellent and the granularity of an image becomes low. However, with a long-time use, a roughness of the surface of the developer roller 22 is degraded, and a problem of a degradation of a carrying ability of the developer occurs. As a result, the developer carried to the developing area is reduced with time, and problems of the degradation and the unevenness of the density occur. On the other hand, a degradation with time of a roughness on the surface of the developer roller 22 by the grooving process is small; therefore the carrying ability of the developer is stable.

Figure 4:
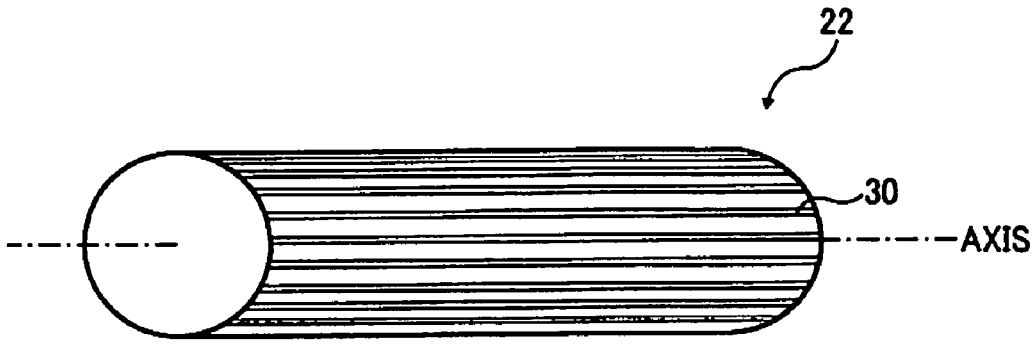
FIG. 4 is an enlarged view where a linear groove is formed on the developer roller surface.
Figure 5:
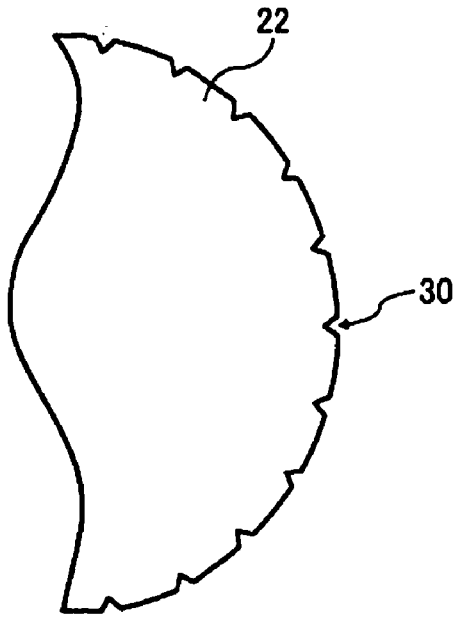
FIG. 5 is a cross-sectional view where a v-shape groove is formed on the developer roller surface.

As for the grooving process, as illustrated in FIGS. 4 and 5, a linear v-shape groove 30, in which a triangle-shape cross-section is cyclically cut parallel to an axis of the developer roller on the surface of the developer roller 22, is widely used. However, an unevenness of a pitch corresponding to the groove pitch in a circumferential direction may occur. In addition, the linear v-shape groove 30 is formed perpendicularly to a carrying direction of the developer; therefore it is hard for the developer to move in an axis direction while being carried to the developing area. If it is hard for the developer to move in the axis direction, the developer is carried to the developing area in a state of having a subtle unevenness to the axis direction in a case of being carried by the developer roller 22, and the unevenness of the density in regard to the axis direction and the degradation of the dot reproducibility may occur.

Figure 6:
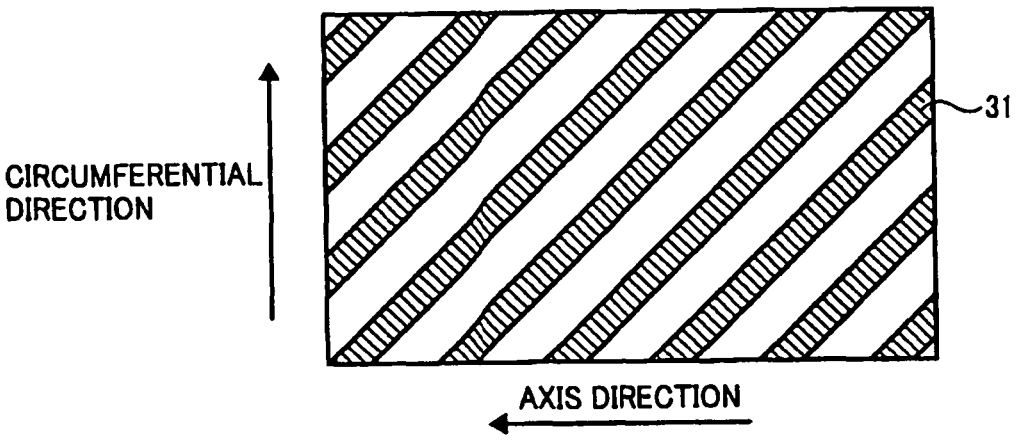
FIG. 6 is an enlarged view where a diagonal groove is formed on the developer roller surface.
Figure 7:
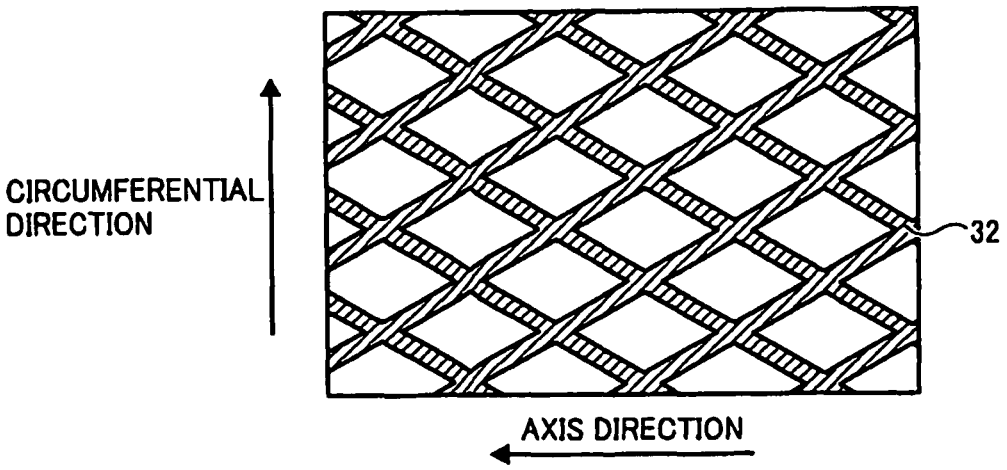
FIG. 7 is an enlarged view where a diagonal grid groove is formed on the developer roller surface.

Therefore, as illustrated in FIG. 6, a diagonal groove 31, which is inclined in one direction to the axis and is formed uniformly in the circumferential direction, is known. In the diagonal groove 31, the unevenness of carrying the developer corresponding to the groove pitch in regard to the circumferential direction is prevented, and since the developer is also moveable in the axis direction when the developer is carried, the uniformity of the distribution of the developer is improved. However, since the diagonal groove 31 is inclined to the one direction to the axis, the developer receives a force in one side direction to the axis and may lean to one side end. In the one side end where the developer leans, a density rise or a stress of the developer is increased, and in other side end, a degradation of the density or a cyclic unevenness is easily conspicuous.

Additionally, a diagonal grid groove 32 is provided where a grid interval is formed uniformly on a surface. In the diagonal grid groove 32, grooves are crisscrossed, and thereby the developer does not lean to the one side on the developer roller 22 and the uniformity of the distribution is improved. However, since in the diagonal grid groove 32, there are intersections in the grooves, a variation of an image density, which is called an unevenness of an intersection, may occur.

Figure 8:
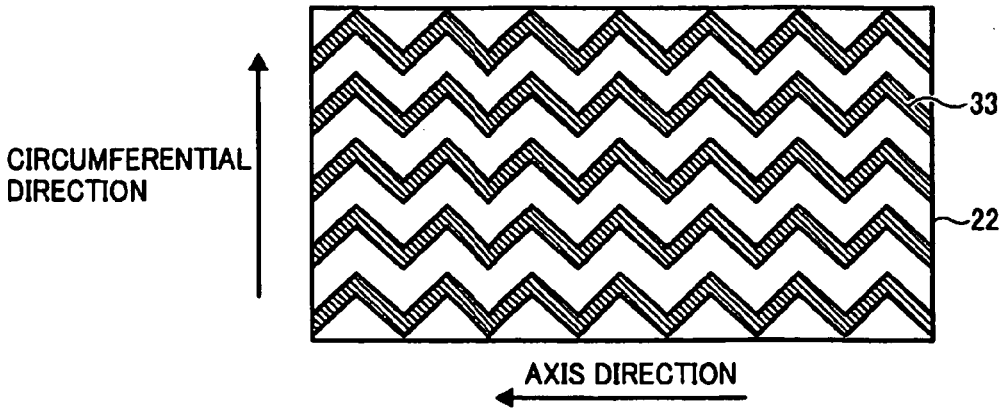
FIG. 8 is an enlarged view where a triangle-wavy-line groove is regularly formed on the developer roller surface in regard to a circumferential direction.
Figure 9:
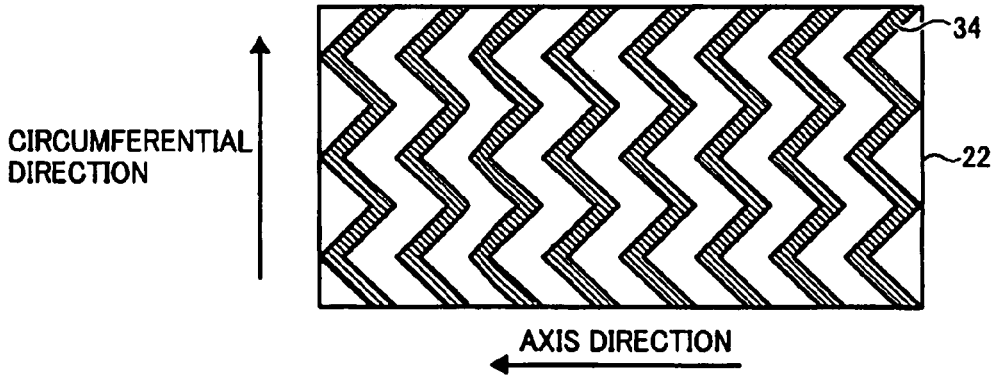
FIG. 9 is an enlarged view where the triangle-wavy-line groove is regularly formed on the developer roller surface in regard to an axis direction.

Then, in a developer roller 22 of the present embodiment of the present invention, a triangle-wavy-line groove which is wavy-lined where an inclination direction to the axis is cyclically changed in an opposite direction and does not mutually intersect with the other groove is provided. FIG. 8 is a schematic structure diagram in which a triangle-wavy-line groove where an inclination direction to the axis alternately changes is regularly provided in regard to the circumferential direction. And FIG. 9 is a schematic structure diagram in which a triangle-wavy-line groove where an inclination direction to the axis alternately changes is regularly provided in regard to the axis direction. A groove 33 of FIG. 8 and a groove 34 of FIG. 9 are inclined to the axis; therefore compared with the linear groove 30 which is parallel to the axis described above, an unevenness of carrying the developer corresponding to a groove pitch is prevented, and it is easy for the developer to move in the axis direction when the developer is carried. And thereby, it is possible to improve a uniformity of a distribution of the developer. In addition, since the inclination direction to the axis is cyclically changed in the opposite direction, unlike the diagonal groove 31 which is inclined to the one direction described above, the developer does not lean to one side, and it is possible to improve the uniformity of the distribution of the developer. Moreover, unlike the diagonal grid groove 32, there is no intersection of grooves, and thereby there is no possibility that the unevenness of the intersection occurs. Furthermore, the linear groove 30 receives a force perpendicularly when passing through the doctor blade 24; however the triangle wavy line grooves 33, 34 do not receive a force perpendicularly when passing through the doctor blade 24, and thereby a stress to the developer is reduced and it is possible for the developer to achieve a long life. Comparing a shape of the groove of FIG. 8 to a shape of the groove of FIG. 9, the shape of the groove of FIG. 8 lessens a possibility that the developer slides and a carrying ability is degraded and is more suitable.

As illustrated in FIG. 8, grooves are formed to overlap with a top part of a mountain of a groove and a bottom part of a valley next to the mountain of a groove which is next to the (former) groove when looking from a circumferential direction (a perpendicular direction to the axis direction). The triangle-wavy-line groove 33 is approximately uniformly formed in regard to the perpendicular direction to the axis direction, and an effect of reducing an unevenness of a groove pitch is increased. Similarly, in FIG. 9, grooves are formed to overlap with a top part of a mountain of a groove and a bottom part of a valley next to the mountain of a groove which is next to the (former) groove when looking from the axis direction.

An inclination angle of a groove of the developer roller 22 is in a range of 20 degrees to 45 degrees to a rotation axis of a developer roller 22. If the inclination angle is smaller than 20 degrees, an effect of controlling the unevenness of the pitch corresponding to the groove pitch becomes small. If the inclination angle is larger than 45 degrees, the carrying ability of the developer is degraded and a problem of a carrying defectiveness may occur.

Figure 10:
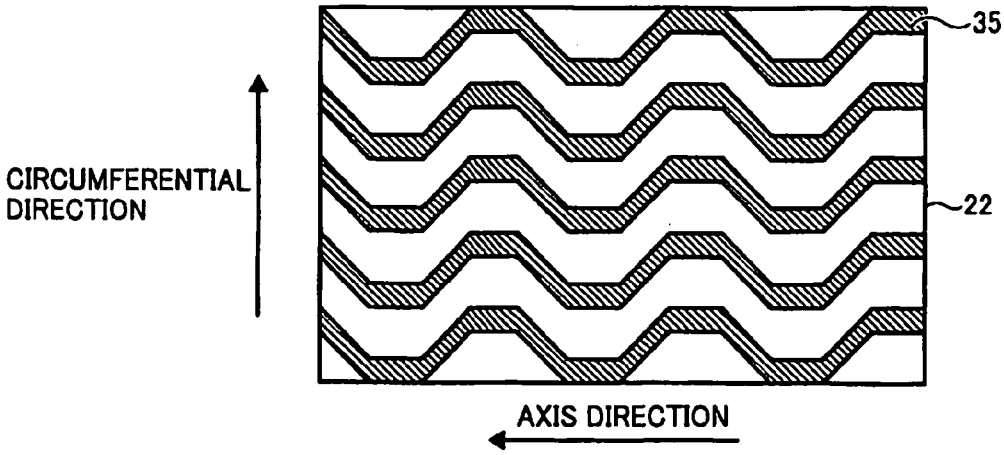
FIG. 10 is an enlarged view where a wavy-line groove having a parallel part in regard to the axis in which an inclination direction of the wavy-line groove is changed in an opposite direction is formed on the developer roller surface.

It is preferable that a groove of the developer roller 22 be wavy-lined in which an inclination direction to the axis is cyclically changed in the opposite direction. And as illustrated in FIG. 10, a groove 35 having a parallel part to the axis between a part where the inclination direction is changed in the opposite direction is also preferable.

Figure 11:
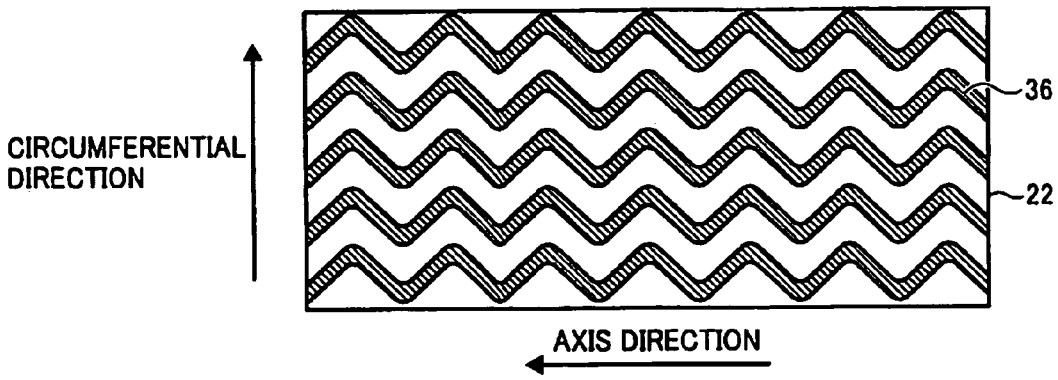
FIG. 11 is an enlarged view where an angle part in which the inclination direction of the wavy-line groove is changed is curved.

And as illustrated in FIG. 11, a groove 36 in which a top part of the mountain or of a bottom part of the valley is formed by a curved-line is more preferable. The mountain or the valley is smoothly formed, and thereby a degradation of the dot reproducibility is controlled and it is possible to obtain a higher picture quality of an image.

Here, there is a measurement of a granularity as a method of evaluating an output image of the image forming apparatus. The granularity is a value of evaluating a uniform distribution of a dot and used for evaluations of a subtle unevenness of a pitch corresponding to a groove pitch and an accuracy of the dot reproducibility. The granularity represents that the dot distributes more uniformly as the value of the granularity is lower. The measurement of the granularity will be described later in the embodiment; however details are disclosed in Japanese patent publication number 2005-84656.

Experimental Example 1

Next, regarding a groove of a developer roller, an image was outputted by use of a developer roller having a condition indicated in Table 1, and an evaluation of a picture quality based on a granularity was considered.

TABLE 1

| | Number of grooves | Groove pitch | Diameter of roller | Groove width | Groove depth |
|---|---|---|---|---|---|
| Type 1 | 150/250 | 0.524/0.314 | 25 | 0.10 | 0.06 |
| Type 2 | | | | 0.15 | 0.06 |
| Type 3 | | | | 0.15 | 0.12 |
| Type 4 | 100/144 | 0.503/0.349 | 16 | 0.10 | 0.06 |
| Type 5 | | | | 0.10 | 0.12 |

(a unit of a numeral value is mm (millimeter) except number of grooves)

In Table 1, a condition where a number of grooves is "150/250" and a groove pitch is "0.524/0.314" indicates that two kinds of rollers, a roller having 150 grooves and a 0.524-mm groove pitch and a roller having 250 grooves and a 0.314-mm groove pitch, are used. Similarly, a condition where a number of grooves is "100/144" and a groove pitch is "0.503/0.349" indicates that two kinds of rollers, a roller having 100 grooves and a 0.503-mm groove pitch and a roller having 144 grooves and a 0.349-mm groove pitch, are used.

Additionally, common conditions in Types 1 to 5 indicated in Table 1 are as follows.

Schematic shape of groove: a wavy-line groove in which a top part of a mountain or of a bottom part of a valley is formed by a curved-line as described in FIG. 11.

Positional relationship of grooves next to each other: wavy-line grooves which are formed to overlap with a top part of a mountain of a wavy-line groove and a bottom part of a valley next to the mountain of a wavy-line groove which is next to the (former) wavy-line groove when looking from a perpendicular direction to the axis direction as illustrated in FIG. 11.

Inclination angle of groove: 30 degrees to an axis of the developer roller.

Figure 14:
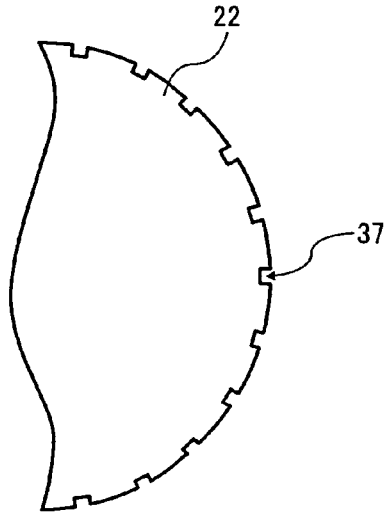
FIG. 14 is an enlarged view where a groove having a flat bottom part is formed on the developer roller surface.

Cross-sectional shape of groove: a cross-sectional shape which is approximately rectangular where a bottom part of the groove is flat as illustrated in FIG. 14 which is described later.

Figure 12:
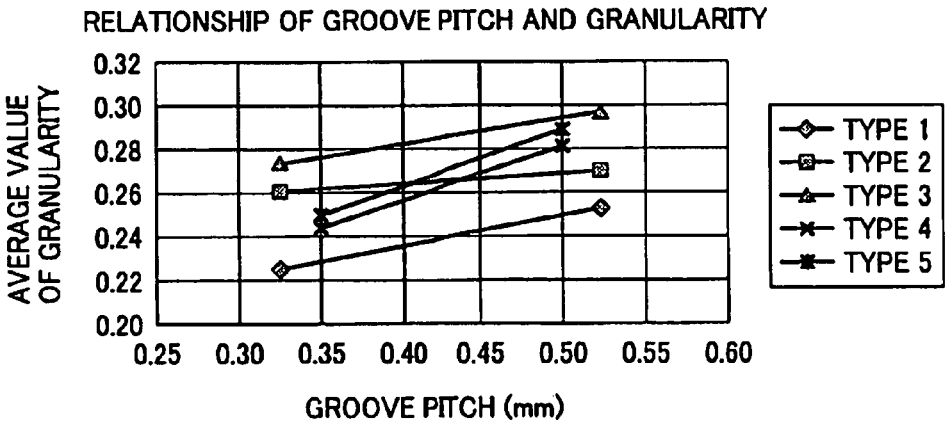
FIG. 12 is a graph which illustrates a relationship of a groove pitch and a granularity.

FIG. 12 is a graph which illustrates a relationship of the groove pitch and the granularity. It is obvious from the graph of FIG. 12 that an average value of granularity is small when the groove pitch is small. As the groove pitch becomes smaller, the uniformity of the developer is improved and the picture quality is enhanced. Particularly, in a case where the groove pitch is less than or equal to 0.4 mm, it was confirmed that the picture quality is greatly enhanced.

Figure 13:
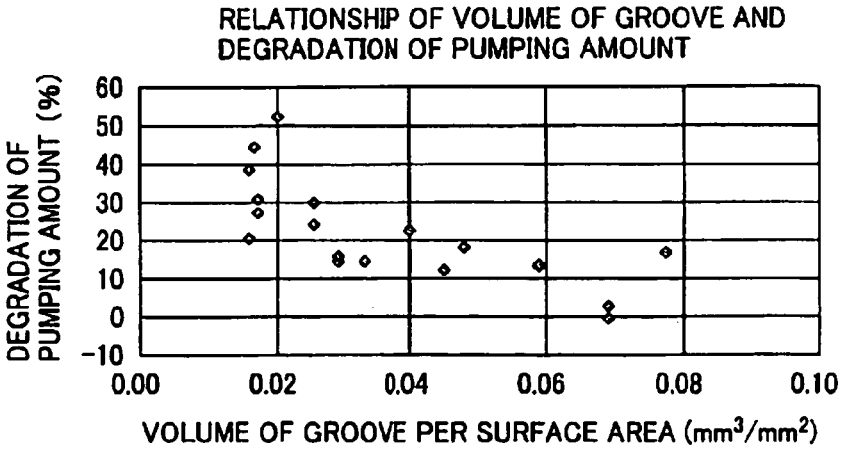
FIG. 13 is a graph which illustrates a relationship of a volume of a groove and a degradation with time of a pumping amount.

Next, the cross-sectional shape of the groove will be explained. A cross-section of the groove is generally a triangle v-shape groove as illustrated in FIG. 5 for the reason of being easily-processed. However, a carrying ability of the developer has a relationship with a volume of a groove, and the carrying ability increases as the volume increases. And in a case of the developer roller 22 with a high carrying ability, it is advantageous to a degradation of a pumping mount of the developer, and durability is high. In FIG. 13, a horizontal axis represents a volume of a groove per square millimeter ($mm^2$) of the developer roller 22, and a vertical axis represents a degradation of the pumping amount of the developer in a case of developing images corresponding to developing 60,000 A-4 size images. As illustrated in FIG. 13, the carrying ability is enhanced by enlarging the volume of the groove, and this makes it possible to control the degradation of the pumping amount of the developer even if the developer is deteriorated.

Accordingly, as for a groove of the developer roller 22 of the present embodiment, as illustrated in FIG. 14, a groove 37 has a flat bottom part and a cross-section of the groove 37 is approximately a rectangle, and thereby the volume of the groove 37 is increased. Therefore, the carrying ability is enhanced and the degradation of the pumping amount of the developer is controlled even if the developer is deteriorated.

In addition, it is obvious from FIG. 13 that a value of the degradation of the pumping amount of the developer is decreased when the volume of the groove per $mm^2$ (square millimeter) of the developer roller is over 0.03 $mm^3$ (cubic millimeter). Stability of a variation of the pumping amount of the developer is improved. Accordingly, durability of a developing device 4 is enhanced by the volume of the groove per $mm^2$ of the developer roller being equal to more than 0.03 $mm^3$.

Experimental Example 2

Figure 15:
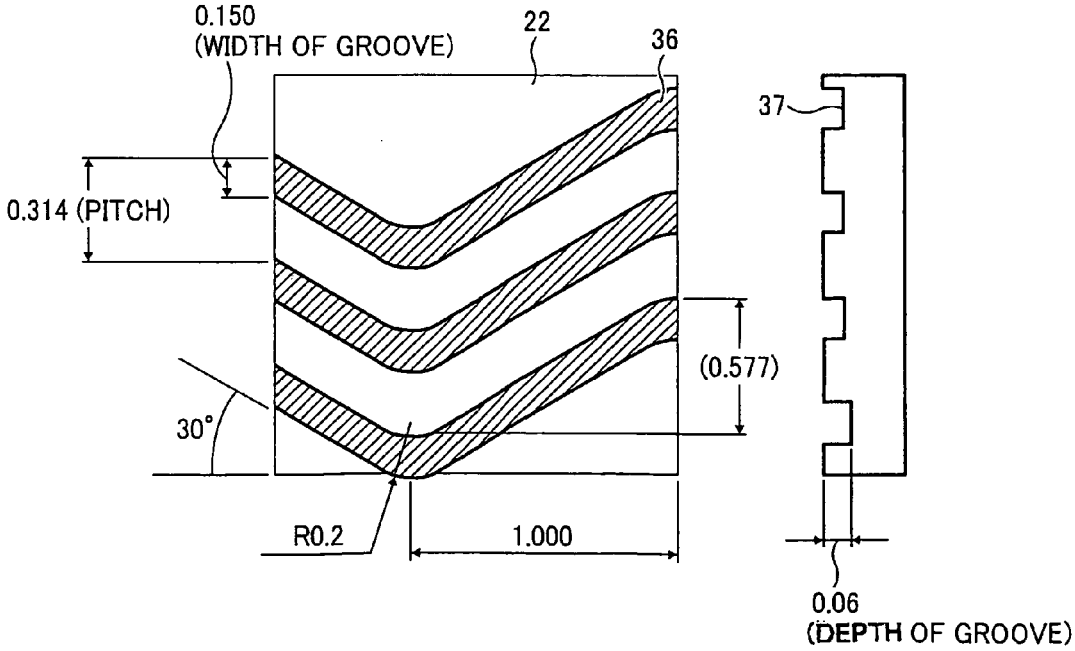
FIG. 15 is an explanatory diagram of conditions of the groove of the developer roller of the embodiment.

A developer roller 22 having a groove 36 of a condition illustrated in FIG. 15 was used for outputting an image, and an evaluation of a picture quality of the outputted image based on a granularity was performed. Additionally, as a conventional object for comparison, a developer roller 22 with a linear v-shape groove 30 was used for outputting an image, and the evaluation of the picture quality of the outputted image based on the granularity was performed. A number of the grooves and a groove width of the developer roller 22 with a linear v-shape groove 30 as the conventional object for comparison are the same as the developer roller 22 having the groove 36 of the condition illustrated in FIG. 15.

Hereinafter, A method of the measurement of the granularity will be explained.

The granularity is defined by a following formula.

$$\text{The granularity}=\exp(aL+b)\int(WSL(f))^{1/2}VFT(f)df$$

L*: average lightness f: spatial frequency (c/mm)

WSL(f): power spectrum of a variation of lightness

VFT(f): visual spatial frequency characteristic a: coefficient (=0.1044)

b: coefficient (=0.8944)

Here, not density D but lightness L* of an image is used. The lightness L* is excellent for linearity of a color space, and adaptability to a color image is also excellent. Hereinafter, the granularity is defined by the above formula and represents a noise of an image. The granularity of the outputted image is measured by the above method, and thereby it is possible to quantify the noise (graininess) of the image. A value of the granularity is that, as can be seen from the definition, in a case where the graininess is small, the value is small, and as the graininess increases, the value becomes larger. Specifically, after scanning the output image by a scanner (Heidelberg NexScan 4100), the granularity based on the above formula was calculated.

Figure 16:
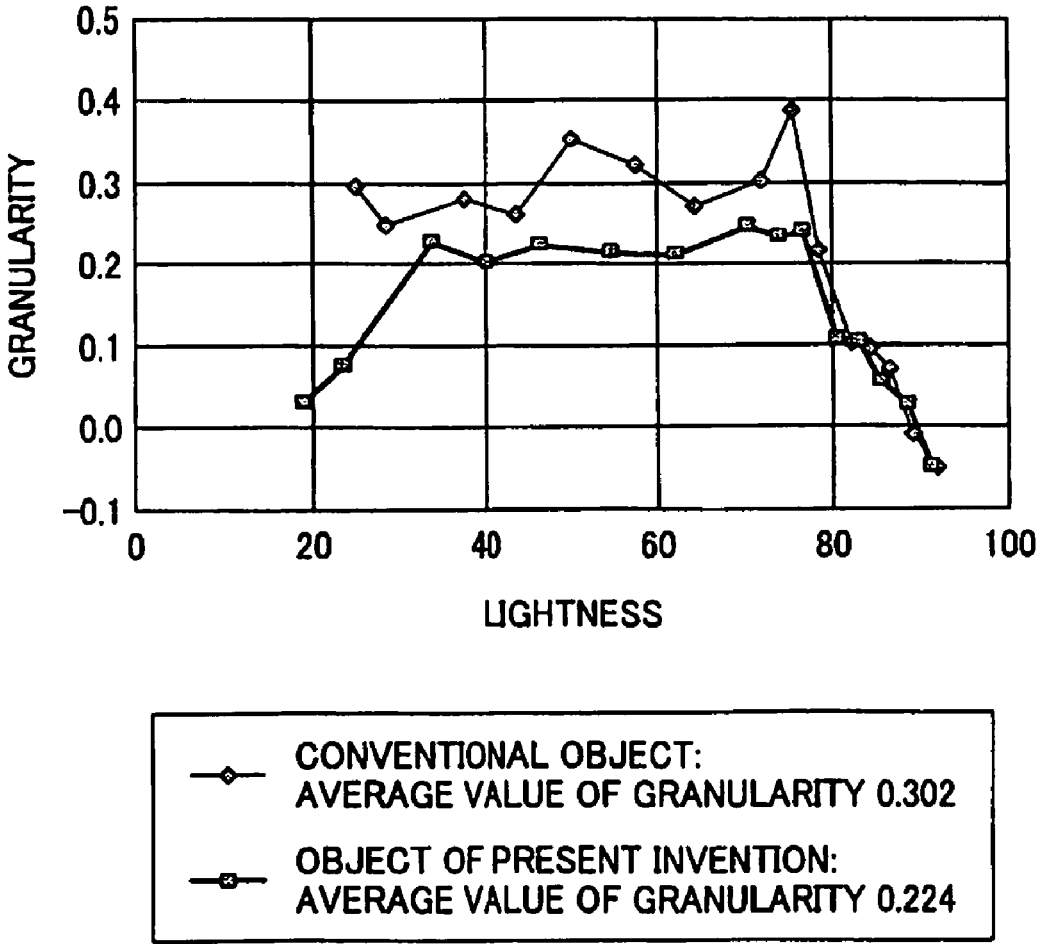
FIG. 16 is a graph which illustrates a result where a granularity of each output image is calculated.

FIG. 16 is a graph which illustrates a calculation result of the granularity of each outputted image. In FIG. 16, a horizontal axis represents lightness, and a vertical axis represents a granularity. In this experiment, in 15 different lightnesses (performing a dithering on 106 screen lines and thereby 15 different lightness patches were made) the granularity of each lightness was calculated.

As can be seen from FIG. 16, as for the developer roller 22 having the groove 36 of the condition illustrated in FIG. 15 as an object of the present invention, in a case where a value of lightness is small (approximately 20 to 30), the granularity is low, that is, an output image becomes a solid image. In a case where the value of lightness is large (approximately 80 to 90), the granularity is low. That is, in each case, the granularity is low, therefore a degree of graininess of the image is low. In an electrophotographic method, particularly in the method using a powder type toner, in a case where values of lightness are 40 to 80, the granularity is high and the degree of graininess is high because of influences such as a variation of a toner size, dust around a toner dot and so on. In a case where values of lightness are 40 to 80 which is high visual-sensitive, the granularity is high, therefore the degree of graininess is high. It is possible to preferably use an average value of the granularity where the values of lightness are between 40 to 80 as an index which represents a picture quality of an image.

As for a silver halide photography and an inkjet printer, the granularity is less affected by lightness. This is because a color pigment of a liquid ink and a photosensitive material of the silver halide photography are ultrafine grains. On the other hand, as for a dot printer or a printer using a toner (a printer of an electrophotographic method, and a toner diameter is equal to more than 7 μm (micrometer)), a variation of a dot shape and a dust phenomenon in a toner transfer occur easily, and the value of the granularity is high, in a case where the values of lightness are 40 to 80. Particularly, in the electrophotographic method, the dot shape varies and the dust phenomenon in the toner transfer occurs easily. The value of the granularity where the values of lightness are 40 to 80 is an index of the picture quality in the electrophotographic method using a dry toner.

Accordingly, an average value of the granularity where the values of lightness are 40 to 80 was calculated, and an evaluation of the picture quality is performed by use of the average value of the granularity. An indication of the average value of the granularity is the average value<0.25±α In a case where the average value is less than this value, an image appears smoothly in a visibility distance. Particularly, in a case of the average value of the granularity≦0.15, the picture quality of an offset printing level is obtained.

As illustrated in FIG. 16, in this experiment, the average value of the granularity has been improved from a value of the conventional object, 0.30 to a value of the object of the present invention, 0.22. This indicates that the granularity is improved by a shape of a groove of the developer roller 22. Additionally, regarding the durability, a performance equivalent to a developer roller by a conventional grooving process was obtained. It is possible to achieve a high picture quality and a high durability by use of the embodiment of the present invention.

According to the embodiment of the present invention, on a surface of a developer roller 22, a groove which is wavy-lined and where an inclination direction to an axis of the developing roller is cyclically changed in an opposite direction and which does not mutually intersect with other groove, such as a groove 33 of FIG. 8, a groove 34 of FIG. 9 and a groove 35 of FIG. 10, is regularly formed. Since the grooves 33, 34, 35 are inclined to the axis, compared to a linear groove 30 illustrated in FIG. 4, an unevenness of carrying the developer corresponding to a groove pitch is controlled, and when carrying the developer, the developer is easily moved in the axis direction and a uniformity of a distribution of the developer is improved. And the inclination direction to the axis is cyclically changed in the opposite direction; therefore unlike a diagonal groove 31 which is inclined to one direction, which is illustrated in FIG. 16, the developer does not lean in one side, and the uniformity of the distribution of the developer is improved. Moreover, unlike a diagonal grid groove 32, there is no possibility that an unevenness at an intersection occurs because there is no intersection of the groove.

In addition, a top part of a mountain or a bottom part of a valley of the wavy-line groove where the inclination direction is changed is smoothly curved, and thereby a degradation of a dot reproducibility is controlled and an image with a higher picture quality is obtained.

Additionally, wavy-line grooves are formed to overlap with a top part of a mountain of a wavy-line groove and a bottom part of a valley next to the mountain of a wavy-line groove which is next to the (former) wavy-line groove when looking from an axis direction or from a perpendicular direction to the axis direction. Therefore, the wavy-line groove is approximately uniformly formed in regard to the axis direction, or in regard to the perpendicular direction to the axis direction, and an effect of reducing an unevenness of the groove pitch is increased.

In addition, as illustrated in FIG. 12, the groove pitch of the wavy-line groove is less than or equal to 0.4 mm so that the picture quality is improved.

Additionally, a cross-section of the groove is approximately a rectangle having a flat bottom part so that a volume of the groove is increased. And thereby, a carrying ability of the developer is enhanced and a degradation of a pumping amount of the developer is controlled even if the developer is deteriorated.

In addition, as illustrated in FIG. 13, the volume of the groove per $mm^2$ (square millimeter) of the developer roller is equal to or more than 0.03 $mm^3$ (cubic millimeter) so that the durability of the developing device is enhanced.

Moreover, a photoreceptor 1 and the developing device 4 are integrated, and a process cartridge which is detachable from a main body of an image forming apparatus is used, and thereby it is possible to provide the image forming apparatus with easy maintenance.

According to the embodiment of the present invention, since a groove of the developer roller which is inclined to an axis of the developer roller, compared with the above-described linear groove which is parallel to the axis, it is possible to control an unevenness of carrying a developer corresponding to a groove pitch, and for the developer to move easily in the axis direction when carrying the developer, and to enhance a uniformity of a distribution of the developer. In addition, an inclination direction to the axis of the groove is cyclically changed in an opposite direction; therefore, unlike the above-described diagonal groove which is inclined to one direction, the developer does not lean in one side, and it is possible to enhance the uniformity of the distribution of the developer. Moreover, unlike the above-described diagonal grid groove, there is no intersection of the groove; therefore there is no possibility that an unevenness at the intersection occurs.

According to the embodiment of the present invention, it is possible to control an unevenness of a density of an image, enhance a dot reproducibility and obtain a high-quality image by carrying a developer in a state of being uniformly distributed to a developing area by use of a developer carrier having a roughness on a surface by a grooving process.

Although the present invention has been described in terms of exemplary embodiments, it is not limited thereto. It should be appreciated that variations may be made in the embodiments described by persons skilled in the art without departing from the scope of the present invention as defined by the following claims.

What is claimed is:

1. A developer carrier which holds a developer on a surface and is rotatable, comprising:

a plurality of non-intersecting grooves which is formed on the surface, wherein each of the grooves is wavy-lined, an inclination direction of the grooves to an axis of the developer carrier is cyclically changed in an opposite direction, the grooves are respectively arranged at intervals, and the grooves are arranged so that a top part of a mountain of a first groove and a bottom part of a valley of a second groove next to the first groove are overlapped in a direction perpendicular to an axis direction or in the axis direction.

2. The developer carrier according to claim 1, wherein a top part of a mountain or a bottom part of a valley of the grooves is curved.

3. The developer carrier according to claim 1 wherein a pitch of the grooves is less than or equal to 0.4 mm.

4. The developer carrier according to claim 1, wherein the bottom part of the grooves is flat.

5. The developer carrier according to claim 1, wherein a volume of the grooves per unit area of the surface is equal to or more than 0.03 $mm^3$.

6. The developer carrier according to claim 1, wherein a maximum inclination angle of each of the grooves is more than 20 degrees and less than 45 degrees to a rotation axis of the developer carrier.

7. The developer carrier according to claim 1, wherein the direction perpendicular to the axis direction is a circumferential direction.

8. A developing device, comprising:

a developer carrier which holds a developer on a surface and is rotatable, including:

a plurality of non-intersecting grooves which is formed on the surface, wherein each of the grooves is wavy-lined, an inclination direction of the plurality of grooves to an axis of the developer carrier is cyclically changed in an opposite direction, the grooves are respectively arranged at intervals, and the grooves are arranged so that a top part of a mountain of a first groove and a bottom part of a valley of a second groove next to the first groove are overlapped in a direction perpendicular to an axis direction or in the axis direction.

9. The developing device according to claim 8, wherein a top part of a mountain or a bottom part of a valley of the grooves is curved.

10. The developing device according to claim 8, wherein a pitch of the groove is less than or equal to 0.4 mm.

11. The developing device according to claim 8, wherein the bottom part of the grooves is flat.

12. The developing device according to claim 8, wherein a volume of the grooves per unit area of the surface is equal to or more than 0.03 $mm^3$.

13. A process cartridge which is detachable from a main body of an image forming apparatus, comprising:

an image carrier;

at least one of an electrostatic charger and a cleaner; and a developing device according to claim 8, and which are integrated.

14. An image forming apparatus, comprising:

an image carrier;

an electrostatic charger which forms an electrostatic latent image on the image carrier; and a developing device which develops the electrostatic latent image according to claim 8.

15. An image forming method, comprising:

forming an electrostatic latent image on an image carrier where a surface is electrically-charged by an electrostatic charger;

developing the electrostatic latent image into a toner image with the developing device according to claim 8;

transferring the toner image onto a recording medium; and fusing a toner on the recording medium by a fuser.

16. The developing device according to claim 8, wherein a maximum inclination angle of each of the grooves is more than 20 degrees and less than 45 degrees to a rotation axis of the developer carrier.

17. The developing device according to claim 8, wherein the direction perpendicular to the axis direction is a circumferential direction.

* * * * *